US006540667B2

(12) United States Patent
Hickman

(10) Patent No.: US 6,540,667 B2
(45) Date of Patent: Apr. 1, 2003

(54) MARITAL AID

(76) Inventor: Kenneth L. Hickman, 8334 Wind Veil Dr., Houston, TX (US) 77040

( * ) Notice: Subject to any disclaimer, the term of this patent is extended or adjusted under 35 U.S.C. 154(b) by 0 days.

(21) Appl. No.: 09/918,104

(22) Filed: Jul. 30, 2001

(65) Prior Publication Data

US 2002/0022761 A1 Feb. 21, 2002

Related U.S. Application Data

(60) Provisional application No. 60/225,324, filed on Aug. 15, 2000.

(51) Int. Cl.[7] ..... A61H 21/00
(52) U.S. Cl. ..... 600/38
(58) Field of Search ..... 600/38–41; 482/11, 482/121, 126, 127

(56) References Cited

U.S. PATENT DOCUMENTS 5,026,050 A * 6/1991 Leung et al. ..... 482/126
5,127,396 A 7/1992 McAllister
5,399,138 A * 3/1995 Jones ..... 482/122
5,413,548 A * 5/1995 Hoffman ..... 482/121
5,669,862 A * 9/1997 Sayman ..... 482/127
5,674,164 A * 10/1997 Kravitz ..... 482/121
5,690,604 A * 11/1997 Barnett ..... 248/229.15
5,865,715 A 2/1999 Wallick
5,899,837 A * 5/1999 Chen ..... 482/126
5,980,436 A * 11/1999 Cheng ..... 482/121
6,056,705 A 5/2000 Stigar-Brown
6,080,090 A * 6/2000 Taylor et al. ..... 482/121
6,142,929 A 11/2000 Padgett
6,203,491 B1 * 3/2001 Uribe ..... 600/38
6,394,939 B1 * 5/2002 Stein ..... 482/148
6,406,411 B1 * 6/2002 Guagliano et al. ..... 482/121

* cited by examiner

*Primary Examiner*—Max F. Hindenburg
*Assistant Examiner*—Joseph A. Cadugan
(74) *Attorney, Agent, or Firm*—Kenneth L. Nash

(57) ABSTRACT

A sexual assistance device and methods which may be used as a marital aid are disclosed which include two elongate members secured by a pivotal connection. A biasing element, such as a spring coil, is disposed at or adjacent the pivotal connection for biasing the opposite ends of the two elongate members away from each other. Respective supports are provided at the two opposite ends of the two elongate members which are engageable with the operator's legs. A sexually stimulating element, such as a vibrator or the like, is preferably removably attached to the pivotal connection. Thus, the operator may produce reciprocal longitudinal movement inwardly and outwardly, relative to the operator's body, by compressing and uncompressing the two elongate members with the legs of the operator thereby fully controlling movement of the sexually stimulating element by the legs of the operator. The biasing force is preferably relatively weak so as to permit easy closing of the operator's legs while still providing a suitable force to permit the legs to securely contact the ends of the two elongate members.

19 Claims, 5 Drawing Sheets

MARITAL AID

This application claims benefit of U.S. Provisional Patent Application No. 60/225,324 filed Aug. 15, 2000.

BACKGROUND OF THE INVENTION

1. Field of the Invention

The present invention relates generally to sexual assistance or marital aid devices and, more particularly, to apparatus and methods for a sexual assistance device that may be easily held and controlled with the operator's legs whereby the hands are left free.

2. Description of the Background

Prior art sexually assisting or stimulating devices, such as marital aid devices, generally require use of the hands and arms for supporting and controlling movement thereof. In many cases, it would be desirable to leave the hands and arms free while being able to support, manipulate movement, and control marital aid devices such as vibrators and the like, by exclusively using the legs. Moreover, it would be desirable to be able to support and manipulate a variety of different types or shaped vibrators and the like exclusively using the legs.

Consequently, there remains a need for a sexual assistance or stimulating device, such as a marital aid device, that may be supported and physically moved using the legs alone. Preferably such a device would be flexibly constructed such that a wide variety of sexually stimulating elements could be interchangeably used and controlled. Those skilled in the art have long sought and will appreciate the present invention which provides solutions to these and other problems.

SUMMARY OF THE INVENTION

The sexual assistance device and method of the present invention overcomes numerous problems inherent in the prior art devices.

Therefore, it is an object of the present invention to provide an improved sexual assistance or marital aid device.

Another object of the present invention is to provide a marital aid device that may be held and manipulated using the legs.

Another object of the present invention is to provide a means operable for holding and manipulating a wide variety of vibrators and other devices using the legs.

These and other objects, features, and advantages of the present invention will become apparent from the drawings, the descriptions given herein, and the appended claims. It will be appreciated that any presented objects, features, and advantages are not intended to limit the invention but simply to provide an understanding of some of the benefits thereof.

Therefore, a sexual stimulation or sexual assistance device is disclosed that comprises two elongate members pivotally connected to each other at one end with a pivotal connection. A biasing element produces a biasing force between the two elongate members such that the respective ends of the two elongate members opposite the pivotal connection are biased away from each other. Each of the respective ends includes a respective support brace for supporting engagement with the legs of an operator. A sexually stimulating element is secured to the pivotal connection for receipt into an orifice of the operator, e.g. the operator's vagina, whereby movement of the respective support brace for compressing and relaxing the two elongate members by the operator's legs results in a translational movement of the sexually stimulating element for a longitudinal reciprocating engagement within the operator's vagina. In one embodiment, the sexually stimulating element may comprise a vibrator.

A releaseable connection is preferably provided for connecting the sexually stimulating element to the pivotal connection whereby a wide variety of stimulating elements may be substituted. For instance, a method is provided for a substantially V-shaped sexual stimulation device having a pivotal connection for two elongate members that are biased outwardly with respect to each other comprising steps such as connecting a first sexually stimulating element to the pivotal connection, disconnecting the first sexually stimulating element, and then connecting a second sexually stimulating element to the pivotal connection.

Thus, another aspect of invention comprises a removeable stimulating element connector system for connection to the pivotal connection of the first member and a second member wherein the first member and the second member may be biased outwardly with respect to each other such that the connector system comprises a first tubular member for the connection, the tubular member defining a hole therein, a pin member receiveable into the hole removeably for securing the tubular member to the pivotal connection, and a first stimulating element affixed to the first tubular member. The first stimulating element may comprise a vibrator. The connector system may further comprise a second tubular member for the connection, and a second stimulating element affixed to the second tubular member. In one preferred embodiment, the first stimulating element is non-removeably affixed to the first tubular member. The non-removeable connection may further comprise a glued connection, a pinned connection, a riveted connecting, or any other type of permanent connection between the first stimulating element and said first tubular member.

While the present invention will be described in connection with presently preferred embodiments, it will be understood that it is not intended to limit the invention to those embodiments. On the contrary, it is intended to cover all alternatives, modifications, and equivalents included within the spirit of the invention and as may be defined in the appended claims.

DETAILED DESCRIPTION OF THE PREFERRED EMBODIMENTS

Figure 1:
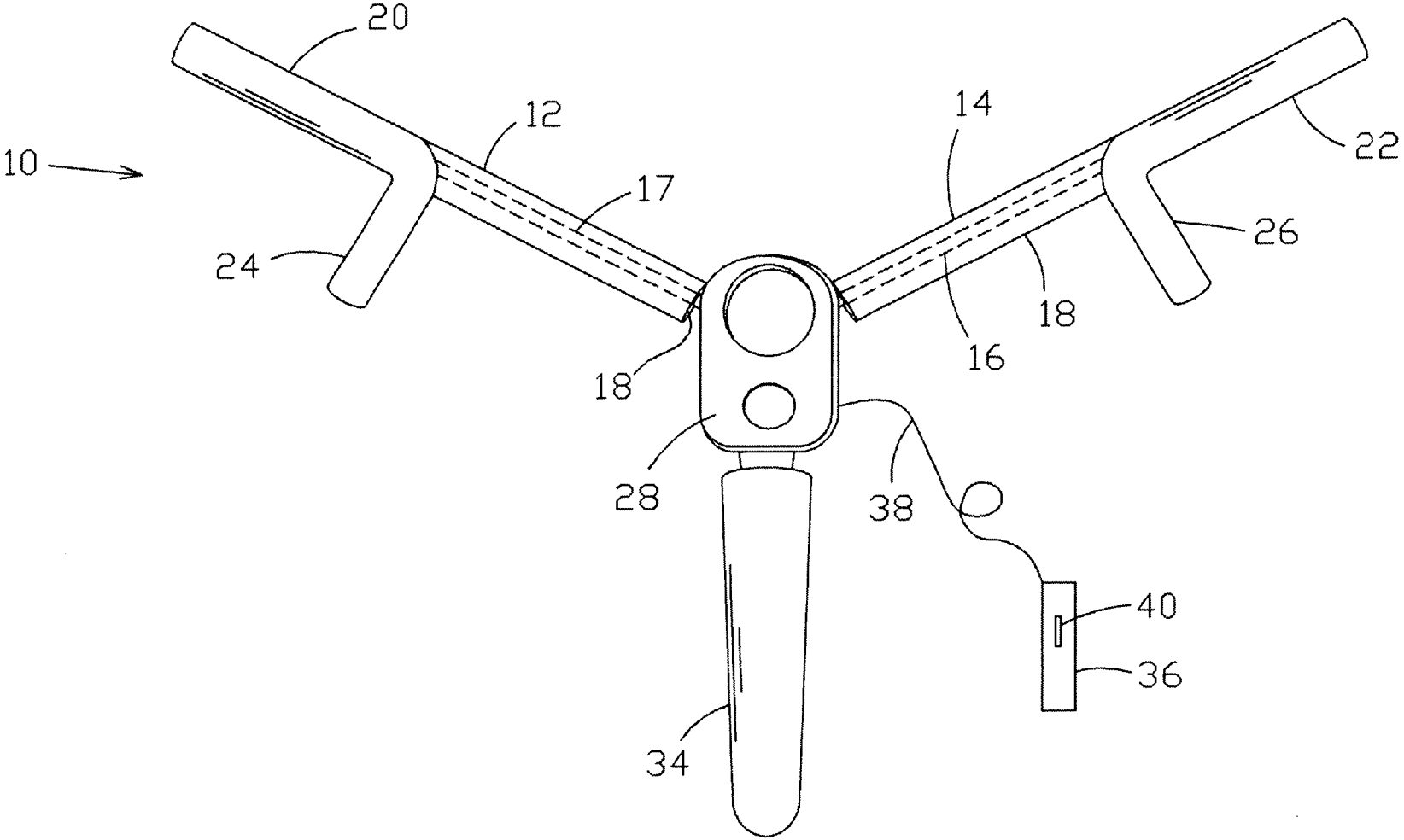
FIG. 1 is a top view, partially in phantom lines, of a marital aid in accord with the present invention.

Referring now to the drawings, and more particularly to FIG. 1, device 10 in accord with the present invention, is illustrated. Device 10 is provided to support and manipulate a vibrator or the like using exclusively the operator's legs.

Device 10 includes spring-loaded support elongate members 12 and 14. Elongate members 12 and 14 preferably are supported by legs 16 and 17 of internal spring 32 that is shown more clearly in FIG. 2A. Surrounding spring legs 16 and 17 is a preferably soft material outer covering 18. In a presently preferred embodiment, a closed cell insulation material is used as is readily available for air-conditioning insulation. However, other materials for comfortably contacting the operator's leg could also be used.

In a presently preferred embodiment, elongate support members 12 and 14 include respective brace sections 20 and 22 which may be formed from wire loops. End sections 24 and 26 preferably extend transversely or substantially at right angles to respective members 12 and 14. Brace sections 20 and 22, and end sections 24 and 26, provide additional contact surface with the operator's legs thereby helping the operator's legs to securely attach and grab device 10. Brace sections 20 and 22 are preferably formed by loops but could also be formed of a flat material or other means whereby a wide section, of approximately four inches more or less in diameter, is formed. Additional end sections could be provided, e.g., such as one end section on either side of the operator's legs, however one end section has been used in a presently preferred embodiment and is found very suitable.

Connector 28 connects to a coil 30 (See FIG. 2A) of spring structure 32 as discussed subsequently. Connector 28 also provides a preferably detachable connection to vibrator 34 in a manner described in more detail subsequently. Because of the detachable connection, other types of vibrators or devices may be quickly and easily attached to connector 28 in place of vibrator 34. Vibrator 34 may include a battery holder 36 connected to vibrator 34 by means of cable 38. Control 40 may be used in a known way to control the vibration intensity, pattern, speed, or the like as is well known.

Figure 2A:
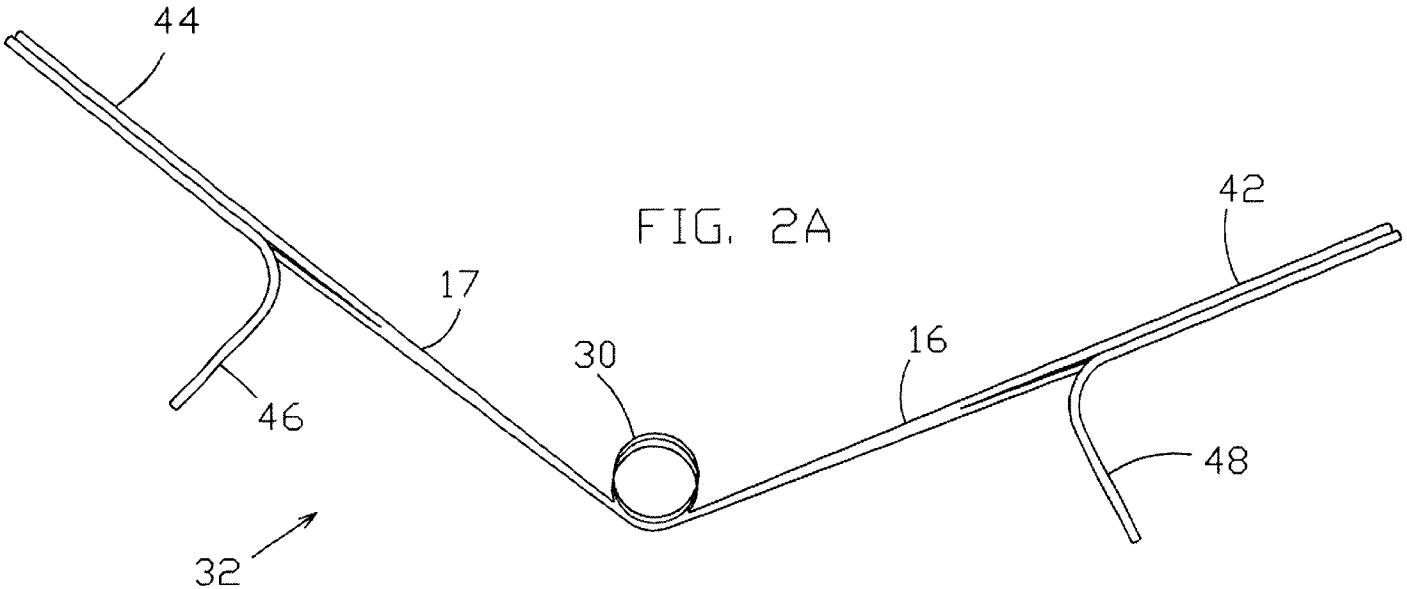
FIG. 2A is a top view of a preferred spring for use in the marital aid of FIG. 1.

Referring to FIG. 2A, spring structure 32 is shown. Spring structure 32 forms a skeleton for device 10. Brace sections 20 and 22 from FIG. 1 are preferably supported by wire loops 42 and 44 in the presently preferred embodiment. End sections 24 and 26 are preferably supported by wire sections 46 and 48. The various wire loops and support sections may be formed by bending the wire in the desired shape.

Coil 30 produces a biasing force that causes spring elements 16 and 17 to move outwardly when the operator's legs move outwardly. Spring elements 16 and 17are easily compressible when the operator's leg compresses members 12 and 14. This biasing force permits the operator to easily grasp and readily maintain device 10 in position between the operator's legs without the need for the use of the operator's hands. It will be noted that the biasing force produced by coil 30 is preferably relatively weak. In a presently preferred embodiment, it is considered to be counterproductive to have a significant biasing force that would make closing or compressing members 12 and 14 towards each other difficult. Thus, in a preferred embodiment, coil 30 is not intended to produce sufficient biasing force to resist muscle movement and effect an exercise machine. Instead, device 10 preferably has a very weak force to allow easy compression for easy manipulation functions as described subsequently. Although it is conceivable that device 10 could be used to exercise the legs with an increased biasing force, the presently preferred light torque due to a light biasing force, as described more precisely subsequently, provides little resistence and allows much easier functioning of device 10 without tiring the operator's legs.

While a spring is provided in the presently preferred embodiment to produce the desired biasing force, it will be understood after viewing the present preferred embodiment that other biasing means such as pistons, cylinders, other spring arrangements, and the like could also be utilized in accord with the mechanical forces preferably utilized as discussed subsequently.

Figure 2C:
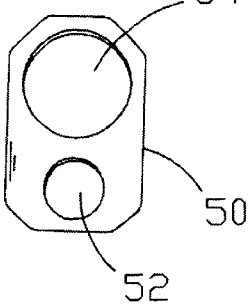
FIG. 2C is an enlarged view of one side piece of the coupling component of FIG. 2B.
Figure 2B:
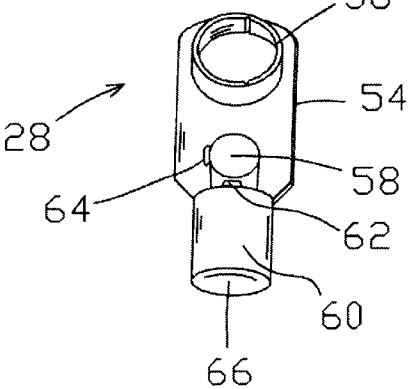
FIG. 2B is an enlarged view of a coupling component for the marital aid of FIG. 1.
Figure 5:
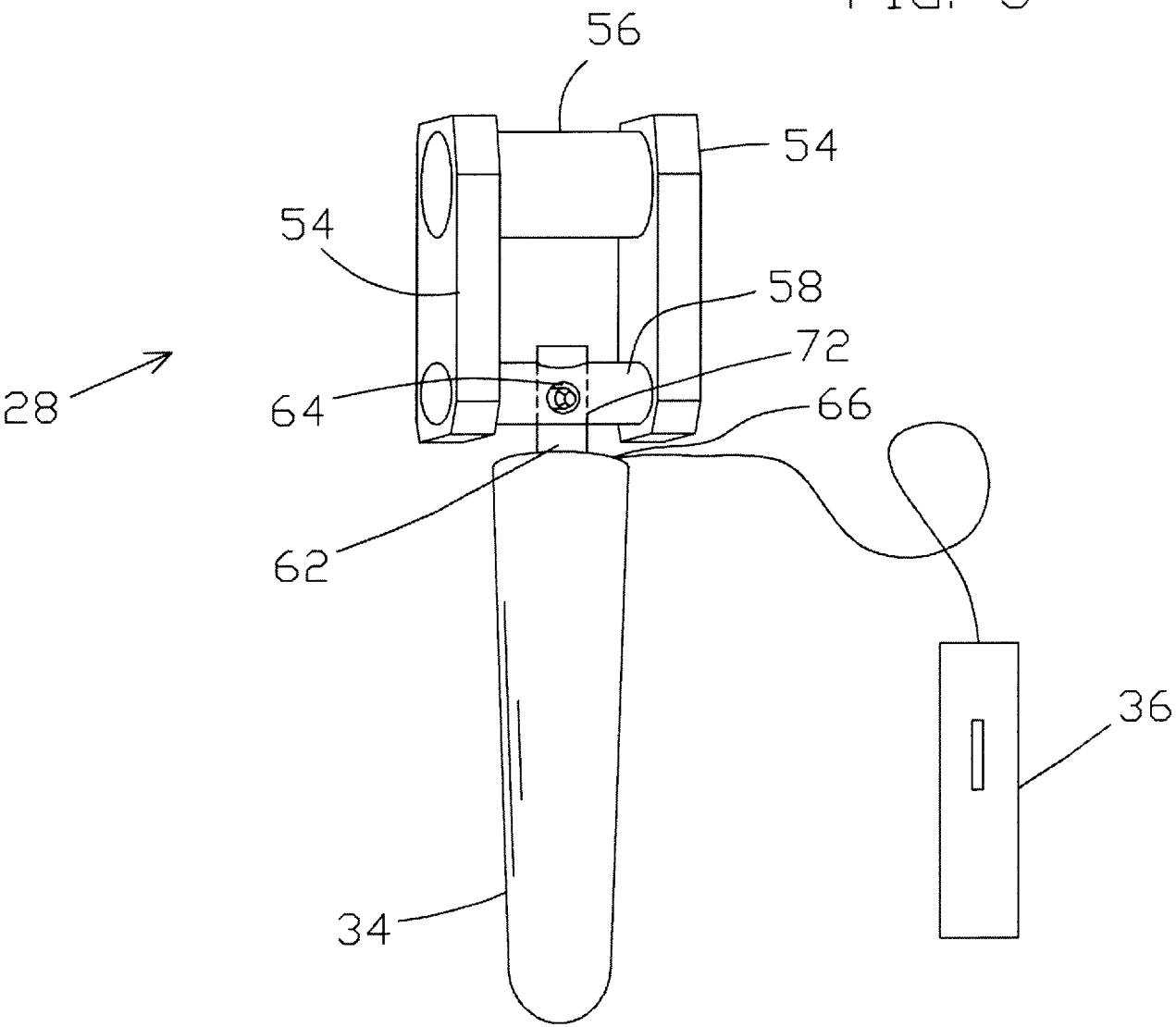
FIG. 5 is an enlarged view, partially in phantom lines, of a coupling component with an attached vibrator element.

Referring to FIG. 2B and FIG. 2C, connector 28 preferably includes two side sections such as side section 50 shown in FIG. 2C. Each side section 50 has two holes 52 and 54 in which cylinders 56 and 58 may be positioned. An enlarged view of these sections is shown in FIG. 5. Large cylinder 56 may be fitted within coil 30 for connection thereto. Small cylinder 58 is used for selective attachment with a device such as vibrator 34. Other cylinder sizes and configurations could also be used. In a preferred embodiment, sides 50 and cylinders 56 and 58 may be conveniently glued together. Other means for connecting the components could also be used such as threads, screws, fasteners, or the like.

Figure 4:
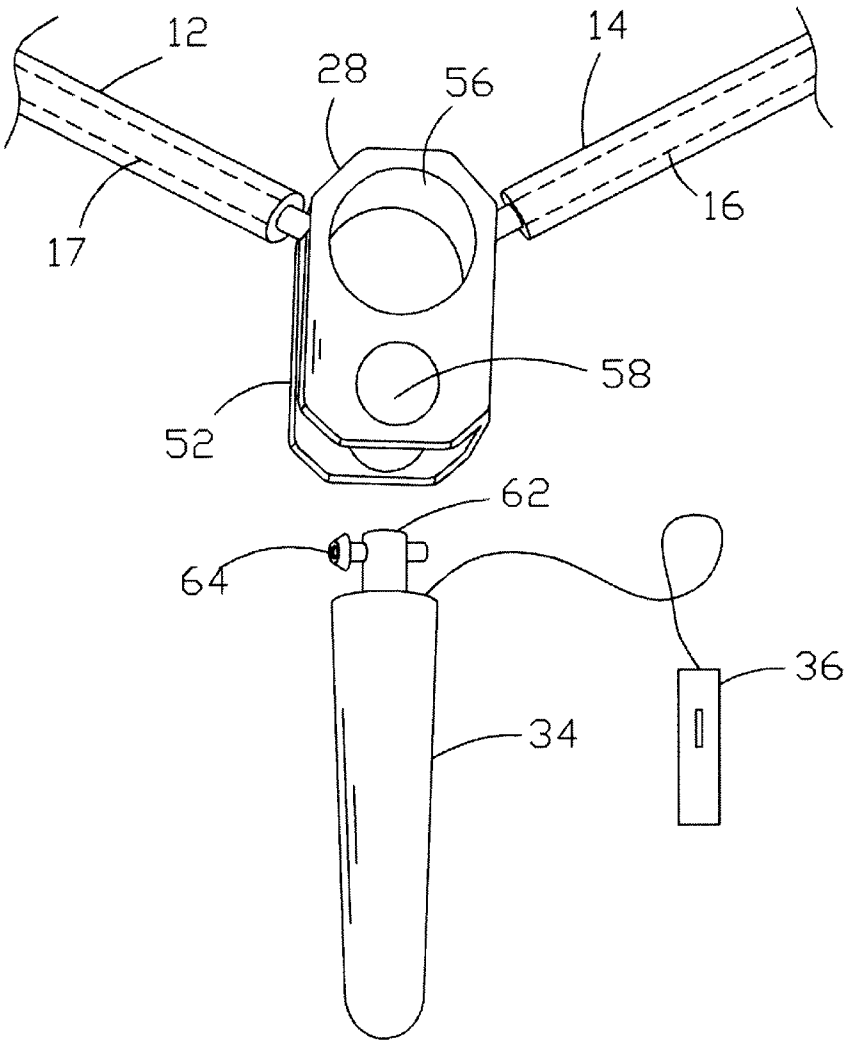
FIG. 4 is an enlarged view, partially in phantom lines, of the marital aid of FIG. 1 with a disconnected vibrator element.

In one presently preferred embodiment, a common connector element 60 (See FIG. 2B) is used. Common connector element 60 includes a shaft 62, as best shown in FIG. 4. Pin 64 is inserted through a hole in shaft 62 and hole 64 in small cylinder 58 for securing shaft 62 to small cylinder 58. Connector element 60 has an attachment surface 66 on the opposite end from shaft 62 which may be glued to a flat surface on various devices such as vibrator 34. In this way, numerous different attachments besides vibrator 34 may be easily and quickly mounted to connector 28. It will be understood that while a specific embodiment for connector 28 has been described for connecting to spring 32 and also to an attachment such as vibrator 34, that other connector elements could also be provided.

Figure 3B:
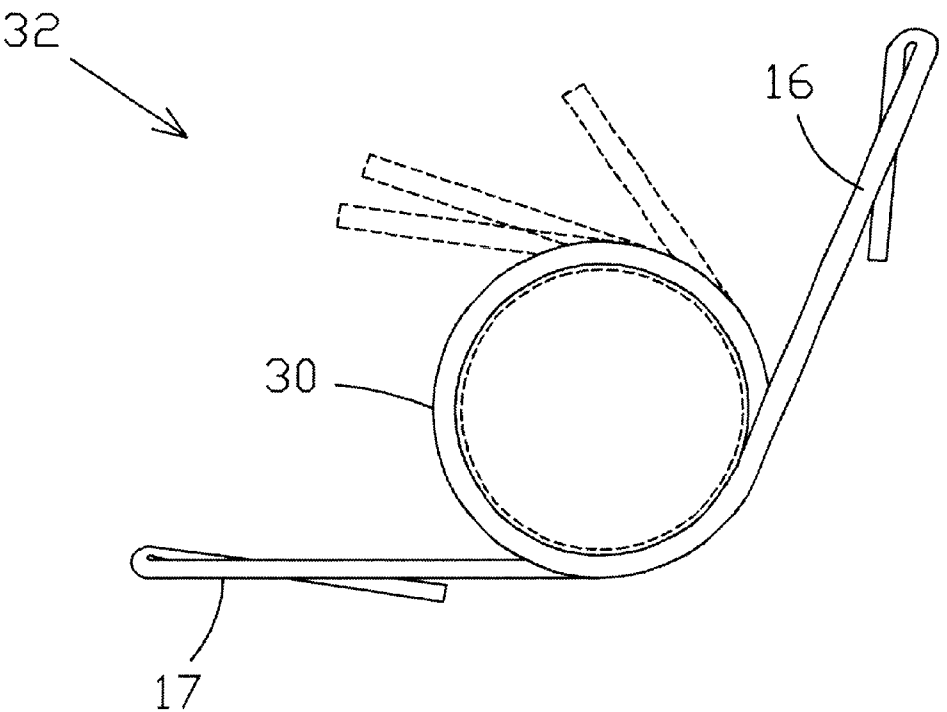
FIG. 3B is top elevational view, with several positions in dash, of the spring of FIG. 3A.
Figure 3A:
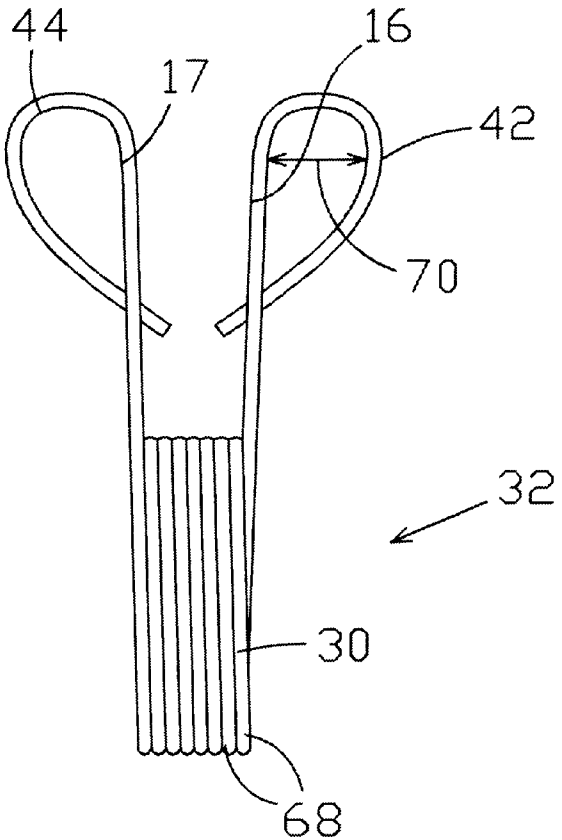
FIG. 3A is a side elevational view of a spring for a marital aid in accord with the present invention.

FIG. 3A and FIG. 3B show details of spring structure 32. The number of turns 68 and thickness of the wire used to make coil 30 is preferably selected so that the biasing force produced on segments 16 and 17 is strong enough to permit a good contact for the operator's legs so as to effectively secure device 10 within the operator's legs but is preferably not so strong as to require excessive exertion. It will be apparent from review of the attached drawings, that each time the operator's legs compress wire segments 16 and 17 that the coil and thus the attachment, such as vibrator 34, will be moved longitudinally in a direction generally bisecting the angle formed between members 12 and 14. This is because support and brace 22 and 26 on one of the operator's legs, and support 20 and brace 24 on the other of the operator's legs, are held in position by the biasing force, so that the connector 28 at the apex of the angle between member 12 and 14 must move away from the apex and is preferably oriented to move into the operator's orifice, e.g, the operator's vagina. Longitudinal movement is a desired movement path for a marital aid which simulates actual sexual activity. Because repeated movements of this type over an extended period of time may be utilized during stimulation, in a preferred embodiment the foot pounds required to effect the longitudinal movement is kept to a minimum.

In one embodiment, coil 30 has from about six to about fifteen turns and may preferably have about eight or nine turns in one presently preferred embodiment. The number of turns changes slightly as the segments 16 and 17 are compressed. The number of turns, thickness of the wire, and length of segments 16 and 17, are factors that may be adjusted to provide a comfortable number of foot pounds required to compress segments 16 and 17, i.e., members 12 and 14. The length of segments 16 and 17 may be in the range of very approximately from one-half foot to about two feet and in a presently preferred embodiment is about one foot. The length is measured from the center or a line through the center of coil 30 to the furthermost ends of segments 16 and 17. The diameter of coil 30 may vary and may preferably vary between about one inch and three inches while in a preferred embodiment the diameter is about two inches. A width 70 of about four inches more or less may be used to form loops 42 and 44. Piano wire is preferably used and in the present embodiment has a diameter of about 0.1 inches but could easily range from about 0.9 inches to about 0.12 inches.

The resting angle between segments 16 and 17 when unloaded or relaxed is preferably about 110 degrees although this angle may vary such as between a preferred range from about sixty degrees to about one hundred forty degrees. A presently preferred range may be from about ninety degrees to about one hundred thirty degrees. Various other ranges of angles and resting angles may be utilized. For instance, resting angles and ranges of angle movement may include arm angles of seventy-five degrees, one hundred twenty degrees, one hundred sixty-five degrees, and one hundred seventy-six degrees. These ranges provide for easy contacting and holding with the legs whereby compression or biasing force between segments 16 and 17 is maintained even when the operator's legs may be opened to a relatively wide amount. As the operator's legs will typically be opening and closing during operation of device 10, maintaining a biasing force allows the operator to maintain a grip or suitable fixed attachment of the operator's legs to the device. While straps or other connection means are not considered necessary, such connection means for affixing the operator's legs to device 10 could also be used if desired. In one presently preferred embodiment, a torque of 2.3 foot-pounds plus or minus 0.2 foot-pounds results in a 45 degree movement of segment 16 with respect to segment 17. Similarly, a torque of 4.6 foot-pounds results in a 90 degree movement. Preferably a relatively light bias which may be described as a torque in foot pounds for compression of 45 degrees and which may be from about 0.5 foot-pounds to about 5.0 foot-pounds with a presently preferred torque being about two to three foot-pounds for a compression of about 45 degrees. This amount has been selected to permit easy opening and closing of the operator's legs while still providing sufficient biasing force to maintain ends 20 and 22 in secured in position on the operator's legs.

FIG. 4 provides an enlarged view at the apex of device 10 where connector 28 is attached to the coil. It can be seen that vibrator 34, or other attachments, are easily and quickly removed or connected to connector 28 by inserting shaft 62 into a receptacle in small cylinder 58. Pin 64, which may be spring loaded, may easily and conveniently secure shaft 62 in the receptacle of small cylinder 58.

FIG. 5 shows an enlarged view of connector 28 with vibrator 34 attached thereto. As stated hereinbefore, large cylinder 56 which is sized to mate to the diameter of spring coil 30, preferably extends through the coil for securing connector 28 to device 10. Then shaft 62 extends into receptacle 72 in small cylinder 58 where it may be removably secured therein by means of pin 64. Various materials may be used to make connector 28 but a presently preferred embodiment is made from plastic whereby the components are relatively inexpensively manufactured.

In one possible example of operation, the operator may engage elongate members 12 and 14 with the inner thighs of her legs. The relative position of device 10 is easily maintained by spring pressure and supported by brace sections 20 and 22 as well as end sections 24 and 26. If a vibrator or the like are used, then the intensity controls may be adjusted and, in fact, the operator's hands are free to vary intensity controls as desired. The vibrator 34 may be inserted in the operator's vagina for operation as a sexual assistance device such as a marital aid. Thrusting longitudinal movement to move vibrator 34 into and out of the operator's vagina is controlled by the operator by squeezing and expanding her inner thighs. The amount or longitudinal stroke length of such movement, and the rate of movement, may be selectively varied by the operator by the degree or angular span which the operator's legs open and close as well as the speed or rate of opening and closing by the operator. Thus, the operator can selectively choose long strokes at slow speeds, short strokes at faster repetition rates, and the like, simply completely by controlling her legs. This allows the operator to maintain her hands and arms completely free as may be desired for other purposes.

The foregoing disclosure and description of the invention is illustrative and explanatory thereof, and it will be appreciated by those skilled in the art, that various changes in the size, shape and materials as well as in the details of the illustrated construction or combinations of features of the marital aid device may be made without departing from the spirit of the invention.

What is claimed is:

1. A sexual stimulation apparatus, comprising:

a first elongate member;

a second elongate member;

a pivotal connection between said first elongate member and said second elongate member;

a biasing element for biasing said first elongate member away from said second elongate member;

a first stimulating element secured to said pivotal connection operable for receipt into an orifice of an operator;

a first leg brace disposed on said first elongate member distal said pivotal connection for engaging a first of said operator's legs, and a second leg brace disposed on said second elongate member distal said pivotal connection for engaging a second of said operator's legs such that compression and decompression of said first elongate member toward and away from said second elongate member with an operator's legs produce longitudinal movement of said first stimulating member in an inwardly direction into said orifice and then an outwardly opposite direction within said orifice.

2. The apparatus of claim 1, wherein said first leg brace comprises a coil.

3. The apparatus of claim 1, wherein said first stimulating element comprises a vibrator.

4. The apparatus of claim 1, further comprising:

a releasable connection for releasably connecting said stimulating element to said pivotal connection.

5. The apparatus of claim 4, further comprising:

a second stimulating element for selective replacement with said first stimulating element.

6. The apparatus of claim 1, wherein said biasing element further comprises a spring coil.

7. The apparatus of claim 1, wherein said biasing force requires a force in the range of 0.5 foot-pounds to 5.0 foot-pound for compressing said first elongate member with respect to said second elongate member by 45 degrees.

8. A method for forming a sexual stimulation apparatus, comprising:

pivotally connecting a first elongate member to a second elongate member to form an apex;

biasing said first elongate member away from said second elongate member; and attaching a first sexually stimulating element to said apex such that compression of said first elongate member with respect to said second elongate member results in longitudinal movement of said first sexually stimulating element in a thrusting manner.

9. The method of claim 8, further comprising:

providing a second sexually stimulating element, and replacing said first sexually stimulating element with said second sexually stimulating element.

10. The method of claim 8, further comprising:

providing that said first elongate member and said second elongate member is covered with soft material.

11. The method of claim 8, further comprising:

providing that said first elongate member and said second elongate member expand outwardly and come to a rest such that said first elongate member is at an angle from sixty degrees to one hundred and sixty-five degrees.

12. The method claim 8, further comprising:

providing that said first elongate member and said second elongate member are each from about six inches to about two feet in length.

13. The method of claim 8, further comprising:

providing a coil for said biasing such that said coil is formed of wire having a diameter in the range of from 0.1 inches to 0.12 inches.

14. The method of claim 8, further comprising:

engaging said first elongate member and said second elongate member, and alternately compressing and releasing said first elongate member with respect to said second elongate member for moving said first stimulating element back and forth.

15. A removeable stimulating element connector system for connection to a pivotal connection of a first member and a second member, said first member and said second member being biased outwardly with respect to each other, comprising:

a first tubular member for said connection, said tubular member defining a hole therein;

a pin member receiveable into said hole removeably for securing said tubular member to said pivotal connection; and a first stimulating element affixed to said first tubular member.

16. The removable stimulating connector system of claim 15, wherein said first stimulating element comprises a vibrator.

17. The removable stimulating connector system of claim 15, further comprising:

a second tubular member for said connection, and a second stimulating element affixed to said second tubular member.

18. The removeable stimulating connector system of claim 15, further comprising said first stimulating element being non-removeably affixed to said first tubular member.

19. The apparatus of claim 18, wherein said non-removeable connection further comprises a glued connection between said first stimulating element and said first tubular member.

* * * * *